US006348018B1

(12) United States Patent
Ou

(10) Patent No.: US 6,348,018 B1
(45) Date of Patent: Feb. 19, 2002

(54) AMERICAN FOOTBALL SUPPORTED WITH AIR LAYER

(75) Inventor: Tsung Ming Ou, Kaohsiung (TW)

(73) Assignee: Top Ball Trading Co., LTD, Kaohsiung (TW)

( * ) Notice: Subject to any disclaimer, the term of this patent is extended or adjusted under 35 U.S.C. 154(b) by 0 days.

(21) Appl. No.: 09/578,987

(22) Filed: May 25, 2000

(51) Int. Cl.[7] ..... A63B 41/10

(52) U.S. Cl. ..... 473/599; 473/143; 473/148; 473/604; 473/601; 473/595

(58) Field of Search ..... 473/602, 604, 473/605, 610, 611, 597, 593, 599, 601, 603, 595, 598, 143, 148; 446/220, 221

(56) References Cited

U.S. PATENT DOCUMENTS 5,759,123 A * 6/1998 Ou 5,865,697 A * 2/1999 Molitor et al.

* cited by examiner

*Primary Examiner*—Jeanette Chapman
*Assistant Examiner*—Nini F. Legesse
(74) *Attorney, Agent, or Firm*—Raymond Y. Chan; David D. Raymond Patent Group

(57) ABSTRACT

An American football includes a ball cover including four elliptical cover pieces sewn edge to edge together, wherein each cover piece comprises an outer elliptical cover skins, an elliptical inner lining for supporting between the outer cover skin, and an air layer having an predetermined elliptical shape disposed between the outer cover skin and the inner lining, and an inflatable bladder disposed within said ball cover for propping up said ball cover after inflation. So, a predetermined volume of air is provided in the air layer for increasing the elasticity of the outer cover skin, so as to increase the softness of the American football with lower manufacturing cost.

17 Claims, 3 Drawing Sheets

AMERICAN FOOTBALL SUPPORTED WITH AIR LAYER

BACKGROUND OF THE PRESENT INVENTION

1. Field of Invention

The present invention relates to an American football, and more particularly to an American football supported with air layer which increase the softness of the American football with lower manufacturing cost.

2. Description of Related Arts

American football is one of the most popular sports in United States. The conventional American football generally comprises a hollow outer ball carcass and an inflatable bladder disposed within the ball carcass for propping up the ball carcass after inflation. The inflatable bladder can be made of rubber or polyurethane when leather made ball carcass is used. The ball carcass of the American football comprises a plurality of cover pieces sewn edge to edge together to form an ellipsoidal shape. Each of the cover pieces comprises an outer cover skin and an inner lining for supporting between the outer cover skin and the inflatable rubber bladder. One of the most common materials of the outer cover skin is leather. Synthetic leather, such as polyvinyl chloride (PVC) or polyurethane (PU), is another common material for the outer cover skin because of its toughness nature that is more suitable for sewing.

The inner lining of the conventional American football can be made of woven fabric, such as twilled nylon, cotton or other mixing material such as TC, TR. It is well known that the conventional American football is quite stiff to grip, catch, and hold. It is because the inner lining must be strong enough to support the softer outer cover skin to tolerate impact and retain the ellipsoidal shape of the American football. However, it may fails to provide the softness of the American football.

In order to fit different types of playground and different ages of players, different types of American football with different levels of softness and stiffness must be made. For example, the American football for junior players may have softer ball carcass and the American football for professional players may have stiffer ball carcass. So, an alternative is sought for.

An improved American football has found that the outer cover skin of the ball carcass has increased its thickness in order to provide the softness of the American football. However, even by increasing of the thickness of the outer cover skin, the desired softability of the American football cannot be reached but the cost of the American football will be relatively expensive.

Other American football comprises a cushion layer made of foam material attached between the outer cover skin and the inner lining for providing the softness of the American football. However, the manufacturing cost of incorporating the cushion layer with the American football will be increase.

SUMMARY OF THE PRESENT INVENTION

A main object of the present invention is to provide an American football supported with air layer which increase the softness of the American football with lower manufacturing cost.

Another object of the present invention is to provide an American football supported with air layer, which has a softer feeling to reduce the painful during ball passing and catching, especially suitable for children, training players and amateur players.

Another object of the present invention is to provide an American football supported with air layer which can reduce the impact force between the player and the football, so as to prevent an unwanted injure of the player hit by the impact force while receiving the football. Thus, the air layer tolerates more impact on the American football so as to retain the ellipsoidal shape of the American football.

Another object of the present invention is to provide an American football supported with air layer, which does not requires to alter the original structural design of the conventional football, so as to maintain the stiffness of the conventional football.

Another object of the present invention is to provide an American football wherein the stiffness and softness of the football can be designated by adjusting the volume of air of the air layer, so that different types of American football with different levels of softness and stiffness can easily be made for fitting different types of playground and different ages of players.

Accordingly, in order to accomplish the above objects, the present invention provides an American football, which comprises a ball cover having a valve hole thereon and an inflatable bladder disposed within the ball cover for propping up the ball cover after inflation.

The inflatable bladder has a predetermined shape and a valve stem mounted thereon and extended through the valve hole of the ball cover. The ball cover comprises four elliptical cover pieces sewn edge to edge together. Each of the cover pieces comprises an outer elliptical cover skins made of leather or synthetic leather, such as polyvinyl chloride (PVC) or polyurethane (PU), an elliptical inner lining for supporting between the outer cover skin and the inflatable bladder, and an air layer disposed between the outer cover skin and the inner lining wherein the air layer has a predetermined volume of air provided therein for increasing the elasticity of the outer cover skin.

DETAILED DESCRIPTION OF THE PREFERRED EMBODIMENT

Figure 1:
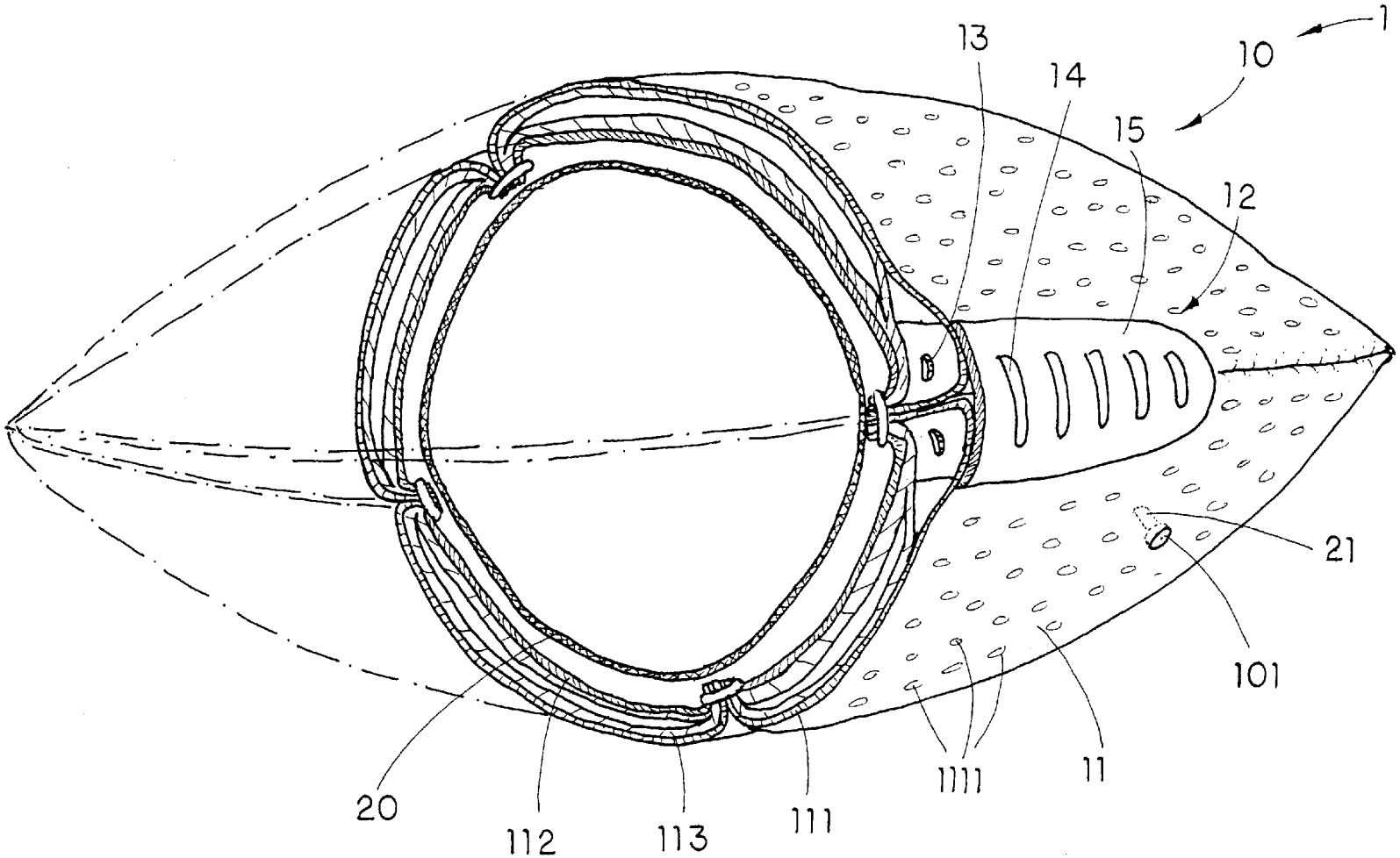
FIG. 1 is a partial sectional perspective view of an American football supported with air layer according to a preferred embodiment of the present invention.

Referring to FIG. 1 of the drawings, an American football 1 supported with air layer according to a preferred embodiment of the present invention is illustrated. The American football 1 comprises a ball cover 10 having a valve hole 101 thereon and an inflatable bladder 20 disposed within the ball cover 10 for propping up the ball cover 10 after inflation.

The inflatable bladder 20, which is generally made of rubber or polyurethane, has a predetermined shape and a valve stem 21 mounted thereon and extended through the valve hole 11 of the ball cover 10. As shown in FIG. 1, the ball cover 10 comprises four elliptical cover pieces 11 sewn edge to edge together. Each of the cover pieces 11 comprises an outer elliptical cover skin 111, an inner elliptical lining 112 for supporting the cover skin 111 and enclosing the inflatable bladder 20, and an air layer 113 disposed between the cover skin 111 and the inner lining 112. The cover skin 23 of each of the cover pieces 11 is made of leather, or synthetic leather such as polyvinyl chloride (PVC) or polyurethane (PU) with or without foaming material for backing wherein the inner lining 113 has a size and shape at least equal to the outer cover skin 111. Moreover, the cover skin 111 provides a plurality of protruding pebbles 1111 evenly distributed all over an outer surface thereof, so as to facilitate the gripping and holding of the American football 1 by the players. The inner lining 112 is made of fabric material for providing the stiffness of the football, so as to tolerate impact and retain the ellipsoidal shape of the American football.

Figure 2:
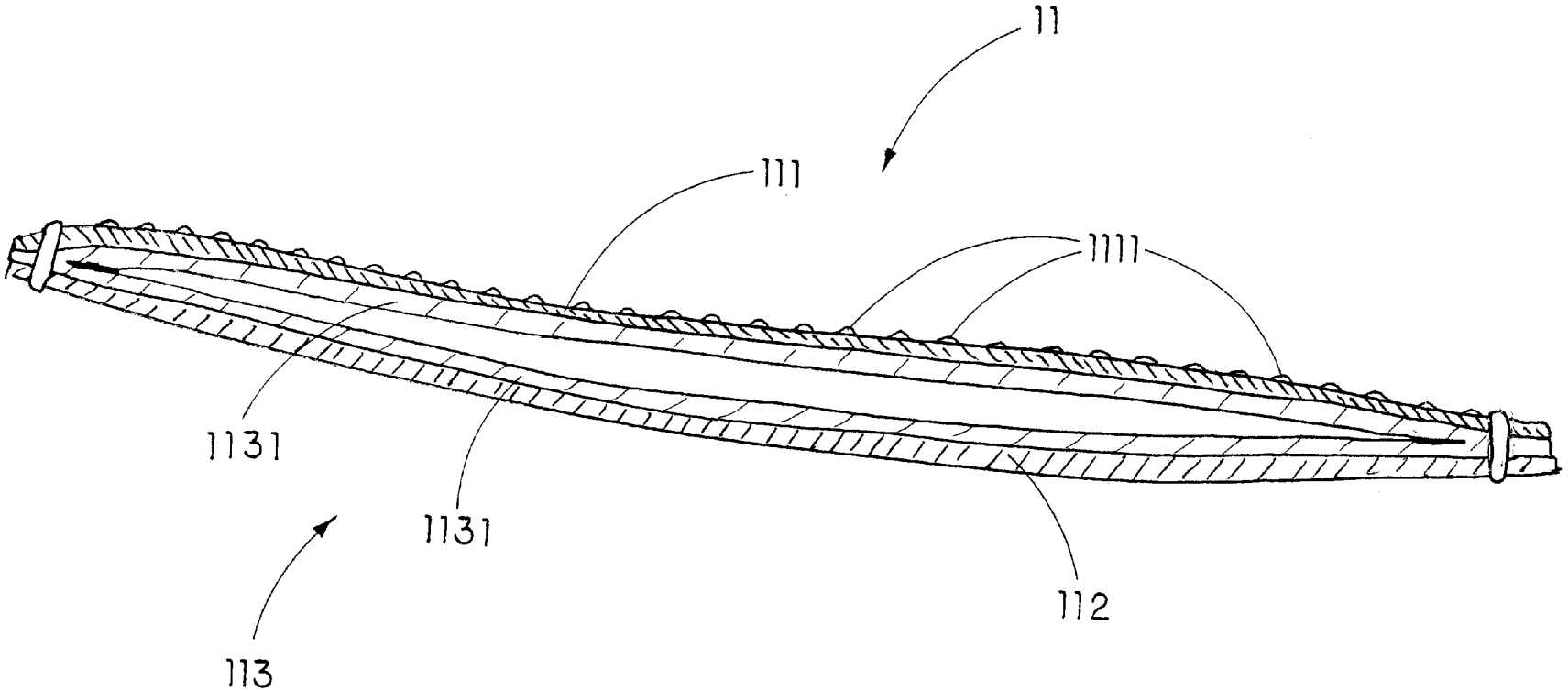
FIG. 2 is a sectional view of the cover piece of the American football according to the above preferred embodiment of the present invention.

According to the first preferred embodiment, the air layer 113 of each cover pieces 11 has a predetermined volume of air provided therein for increasing the elasticity of the cover skin 111. As shown in FIG. 2, the air layer 113 comprises two pieces of thin layer 1131 having non-stretchable properties, which preferably made of thin plastic such as polyurethane (PU) that is inexpensive, cut into a predetermined elliptical shape wherein the outer cover skin 11 and the inner lining 113 each has a size and shape at least equal to the air layer 113 so as to fittingly disposed between the outer cover skin 111 and the inner lining 113. Moreover, the brims of the two thin layers 1131 are sealedly attached together in an air tight manner wherein a predetermined volume of air is trapped therebetween such that the inside air cannot escape from the thin layers 1131 of the air layer 113. In addition, the air is freely flowing inside the air layer 113 so as to increase the elasticity of outer cover skin 111 and reduce the impact force of the American football 1.

According to the present invention, the air layer 113 of each cover piece 11 of the ball cover 10 of the American football 1 is made by a specific method comprising the following steps.

(i) Cut the two thin layers 1131 into elliptical shape.

(ii) Compress the two thin layers 1131 together at their brims in a press mold with heat applied, so as to sealedly attach the two thin layers 1131 together in an air tight manner, wherein a predetermined volume of air is trapped therein.

The two thin layers 1131 of the air layer 113 can be attached together in the press mold with heat applied on the thin layers 1131 with a predetermined width of brim from an edge of the air layer 113 approximately 10 m/m. The predetermined width of the brim of the air layer 113 is used to prevent the air layer 113 being damage while stitching on the inner lining 112. Moreover, ultra-sonic is also capably of sealedly attaching the two thin layers 1131 together in an air tight manner. So, the manufacturing procedure of the air layer 113 is simple and easy and the manufacturing cost of the air layer 113 is relatively inexpensive, so as to minimize the cost of the American football 1.

Figure 3:
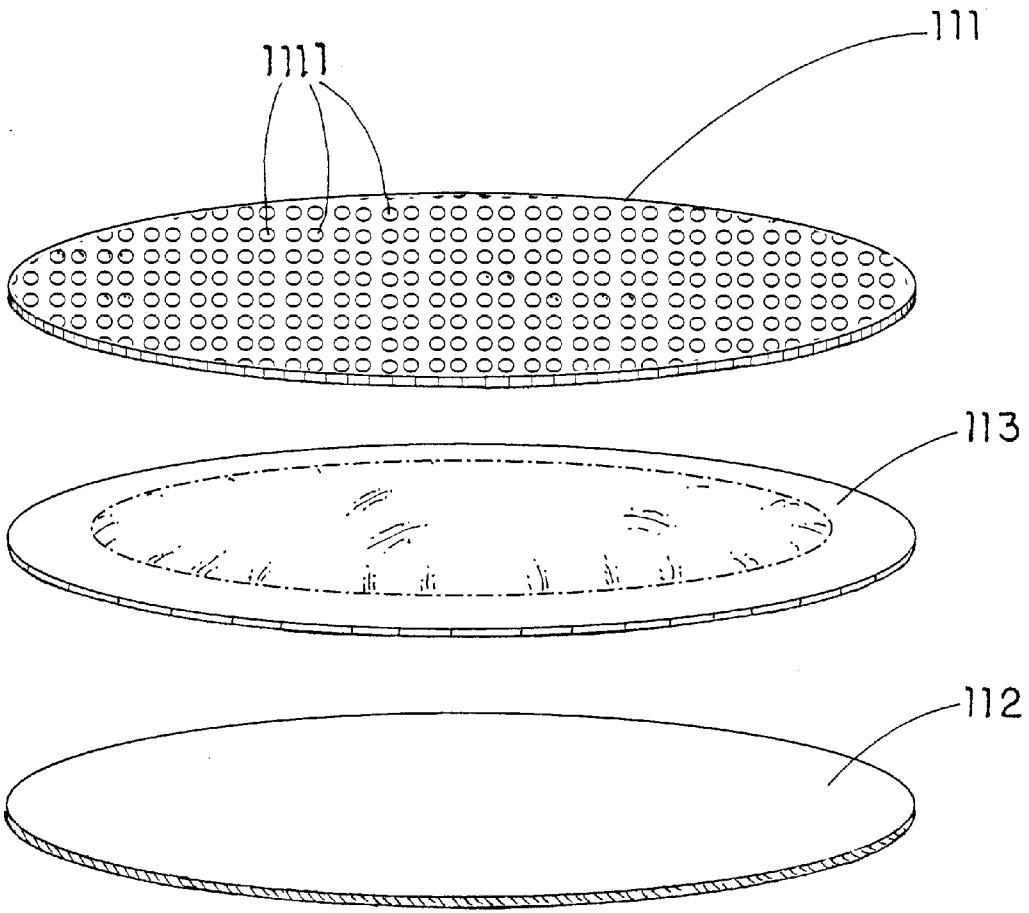
FIG. 3 is an exploded perspective view of the cover piece of the American football according to the above preferred embodiment of the present invention.

In order attach the air layer 113 between the outer cover skin 111 and the inner lining 112, as shown in FIG. 3, each cover piece 10 of the American football 1 is manufactured by the following steps.

1. Cut the outer cover skin 111 into a predetermined elliptical shape.
2. Cut the inner lining 112 into a predetermined elliptical shape, which having a same size of the outer cover skin 111.
3. Stitch the brim of the air layer 113 to the brim of the inner lining 112 so as to securely hold the air layer 113 in position.
4. Attach the outer cover skin 111 on the air layer 113 by glue and/or stitch at the brim of the outer cover skin 111 to the inner layer 112 such that the air layer 113 is firmly attached therebetween.

The American football 1 further comprises an inlet opening 12 provided on an edge section between two of the cover pieces 11, as shown in FIG. 1, wherein the inflatable bladder 20 is adapted to be inserted into the ball cover 10 through the inlet opening 12.

In order produce the American football 1, the following steps can be processed after the above step (4).

5. Sew the four cover pieces 11 edge to edge together to form the ball cover 10 by a sewing machine, wherein the edge section of the ball cover 10 is not sewn to form the inlet opening 12.
6. Insert the inflatable blabber 20 into the ball cover 10 through the inlet opening 12.
7. Sew up the inlet opening 12 by hand or sewing machine to form the American football 1.

In order to provide better attachment between two cover pieces 11, an additional step of adhering the brim of the cover piece 11 by rubber nature glue can be applied in step (5).

In order to reinforce the surrounding portion of the inlet opening 12 of the ball cover 10, the following additional steps can be added into the manufacturing method specified above.

(a) After step (4), sew two linings 15 symmetrically around the inlet opening 12 and a reinforcing underneath the inlet opening 12.

(b) After the above step (a), form a plurality of string holes 13 on the respective cover pieces 11 around the inlet opening 12.

(c) After step (7), tighten a plurality of ball strings 14 around the string holes 13.

In order to prevent the damage of the air layer 113 when forming the string holes 13 on the respective cover pieces 11, the two thin layers 1131 are sealedly attached together at the brim thereof wherein a portion of the brim is encircling the inlet opening 12, as shown in FIG. 1. In other words, the location of the string holes 13 formed on the air layer 113 is sealed together, so as to prevent the air layer 113 from being damage when the string holes 13 is plugged on the ball cover 10

The volume of air inside the air layer 113 can be easily adjusted by pumping air into the two thin layers before they sealedly attached together. When less air is trapped inside the air layer 113, the American football 1 would have stiffer property. Otherwise, when more air is trapped inside the air layer 113, the American football 1 would have a softer nature. So, different types of American football 1 with different levels of softness and stiffness can easily be made for fitting different types of playground and different ages of players. For example, the American football for junior players may have softer ball cover 10 and the American football for professional players may have stiffer ball cover 10.

Accordingly, the American football 1 supported with air layer 113 can highly reduce the impact force thereof. So, the player can prevent an unwanted injure hit by the impact force of the American football 1 while catching or receiving the football 1. Moreover, since the impact force of the football 1 is reduced, in other words, the air layer 113 is capable of providing more durable American football with better supporting but lower manufacturing costs.

Furthermore, the outer cover skin 111 has increased it elasticity with the air layer 113 is attached thereto, so as to tolerate more impact on the outer cover layer 111 and retain the ellipsoidal shape of the American football 1. Thus, the air layer 113 can be act as a conventional cushion layer that has a softer feeling to reduce the painful during ball passing and catching, especially suitable for children, training players and amateur players.

What is claimed is:

1. An American football, comprising:

a ball cover comprising at least four elliptical cover pieces sewn edge to edge together, wherein each cover piece comprises an outer elliptical cover skins, an elliptical inner lining for supporting between said outer cover skin, and an air layer having a predetermined elliptical shape disposed between said outer cover skin and said inner lining, wherein said air layer has a predetermined volume of air provided therein for increasing the elasticity of said outer cover skin, and an inflatable bladder disposed within said ball cover for propping up said ball cover after inflation.

2. An American football, as recited in claim 1, wherein said air layer comprises two pieces of thin layer attached together at their brims in an air tight manner, wherein said predetermined volume of air is trapped therebetween.

3. An American football, as recited in claim 2, wherein said cover piece of said ball cover is produced by:

cutting said outer cover skin into a predetermined elliptical shape;

cutting said inner lining into a predetermined elliptical shape, which having a same size of said outer cover skin;

stitching a brim of said air layer to a brim of said inner lining so as to securely hold said air layer in position; and attaching said outer cover skin on said inner lining by glue and/or stitch at said brim of said outer cover skin to said inner layer for covering said air layer therebetween.

4. An American football, as recited in claim 2, wherein said inner lining and said outer cover skin each has a size and shape at least equal to said air layer.

5. An American football, as recited in claim 4, wherein said cover piece of said ball cover is produced by:

cutting said outer cover skin into a predetermined elliptical shape;

cutting said inner lining into a predetermined elliptical shape, which having a same size of said outer cover skin;

stitching a brim of said air layer to a brim of said inner lining so as to securely hold said air layer in position; and attaching said outer cover skin on said inner lining by glue and/or stitch at said brim of said outer cover skin to said inner layer for covering said air layer therebetween.

6. An American football, as recited in claim 4, wherein said air layer of each cover piece of said ball cover is produced by:

cutting said two thin layers into elliptical shape; and compressing said two thin layers together at their brims in a press mold with heat applied, so as to sealedly attach said two thin layers together in an air tight manner, wherein said predetermined volume of air is trapped therein.

7. An American football, as recited in claim 6, wherein said cover piece of said ball cover is produced by:

cutting said outer cover skin into a predetermined elliptical shape;

cutting said inner lining into a predetermined elliptical shape, which having a same size of said outer cover skin;

stitching a brim of said air layer to a brim of said inner lining so as to securely hold said air layer in position; and attaching said outer cover skin on said inner lining by glue and/or stitch at said brim of said outer cover skin to said inner layer for covering said air layer therebetween.

8. An American football, as recited in claim 6, wherein said thin layers are made of polyurethane which has a non-stretchable properties.

9. An American football, as recited in claim 8, wherein said brim of said air layer has a predetermined width from its edge.

10. An American football, as recited in claim 9, wherein said cover piece of said ball cover is produced by:

cutting said outer cover skin into a predetermined elliptical shape;

cutting said inner lining into a predetermined elliptical shape, which having a same size of said outer cover skin;

stitching a brim of said air layer to a brim of said inner lining so as to securely hold said air layer in position; and attaching said outer cover skin on said inner lining by glue and/or stitch at said brim of said outer cover skin to said inner layer for covering said air layer therebetween.

11. An American football, as recited in claim 10, wherein said brim of said air layer has a predetermined width from its edge.

12. An American football, as recited in claim 2, wherein said thin layers are made of polyurethane which has a non-stretchable properties.

13. An American football, as recited in claim 4, wherein said thin layers are made of polyurethane which has a non-stretchable properties.

14. An American football, as recited in claim 4, wherein said brim of said air layer has a predetermined width from its edge.

15. An American football, as recited in claim 2, wherein said air layer of each cover piece of said ball cover is produced by:

cutting said two thin layers into elliptical shape; and compressing said two thin layers together at their brims in a press mold with heat applied, so as to sealedly attach said two thin layers together in an air tight manner, wherein said predetermined volume of air is trapped therein.

16. An American football, as recited in claim 6, wherein said brim of said air layer has a predetermined width from its edge.

17. An American football, as recited in claim 1, wherein said inner lining and said outer cover skin each has a size and shape at least equal to said air layer.

* * * * *